United States Patent [19]

Lester et al.

[11] 4,151,246

[45] Apr. 24, 1979

[54] MANUFACTURE OF SHORT PIPES

[75] Inventors: Dudley R. Lester, Constantia; Leslie D. Reeves, Pineland, both of South Africa

[73] Assignee: Vianini Pipes (Proprietary) Limited, Randburg, South Africa

[21] Appl. No.: 795,236

[22] Filed: May 9, 1977

[30] Foreign Application Priority Data

May 14, 1976 [ZA] South Africa ..... 76/2893

[51] Int. Cl.[2] ..... B28B 1/10

[52] U.S. Cl. ..... 264/297; 249/100; 249/129; 264/71; 264/278; 264/333; 425/262; 425/427

[58] Field of Search ..... 264/277, 278, 297, 71, 264/333; 249/100, 129, 156; 425/262, 427

[56] References Cited

U.S. PATENT DOCUMENTS

| | | | |
|---|---|---|---|
| 1,592,673 | 7/1926 | Nichols | 264/278 |
| 1,678,633 | 7/1928 | Burchartz | 249/129 X |
| 2,729,873 | 1/1956 | Ludwig | 264/297 X |

*Primary Examiner*—Thomas P. Pavelko
*Attorney, Agent, or Firm*—Young & Thompson

[57] ABSTRACT

Pipes of short length are moulded in a vertical pipe-making machine by locating a series of rings in a circular mould to divide the length of the mould into several compartments, the compartments are filled with settable material, to form a pipe with the rings embedded in it, and the pipe is divided into short lengths by removing the rings. The rings are held in position by stops projected through the wall of the mould into the moulding space, which are withdrawn prior to demoulding. The rings and reinforcement cages are assembled on a jig that is withdrawn before the pipe is moulded.

4 Claims, 8 Drawing Figures

MANUFACTURE OF SHORT PIPES

BACKGROUND OF THE INVENTION

This invention relates to the manufacture of short lengths of pipe, such as are used in the assembly of manhole sections, on vertical pipe-making machines.

The high initial cost of these machines is justified by their large productive capacity. It is found, however, that the time to make a shorter pipe is only slightly less than to make a long pipe and although some manufacturers do use the vertical pipe machines for making manhole sections, which can be described as very short pipes, it is evident that a machine used for this purpose is operating at a low level of output and is being uneconomically used.

The object of the invention is to provide a method of making short lengths of pipe on a vertical pipe-making machine which materially increases the productivity of the machine, to the extent that the economic advantage of the machine in the manufacture of long pipes is to a considerable extent preserved.

STATEMENT OF THE INVENTION

According to the invention, the method consists in locating in the mould of the machine a series of rings coaxial with the mould, that divide the length of the mould into several compartments, filling the compartments with a settable material, causing or allowing the material to set to form a pipe with the rings embedded in it and extending from the inner to the outer surface wall of the pipe; and dividing the pipe into lengths by removing the rings from it.

The rings are contoured to produce in the moulded pipes the end profiles required for pipes, juxtaposed end to end, to mate.

The method of the invention requires that the spacer rings be brought into position before introduction of the moulding material and that they be demoulded together with the pipes. Therefore, prior to introduction of the material, means must be provided for the rings to be maintained in position. Such means may consist of ledges on the inner surface of the mould; but such means is only practical if the mould is separable, to enable the ledges to be withdrawn from the moulded pipes; and even then the usual step of displacing the pipe axially to break its adhesion to the mould is apt to damage the pipe.

The preferred means, and one which is essential when one-piece moulds are used, consists of a series of stops that are projected into the moulding space of the mould through the mould wall, to engage and support the rings, and are withdrawn from the space before demoulding.

DESCRIPTION OF THE INVENTION

Several embodiments of the invention are illustrated in the accompanying drawings in which.

Figure 1:
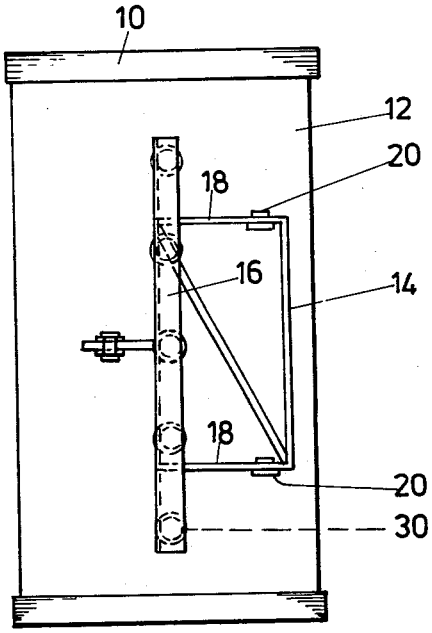
FIG. 1 is a side view of a mould according to the invention.
Figure 2:
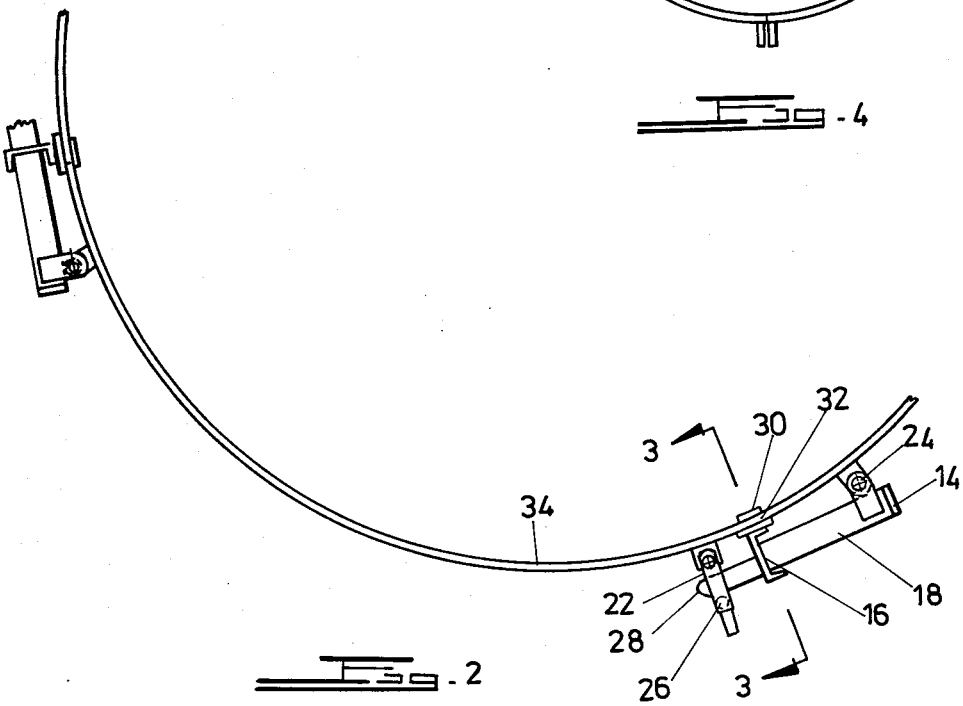
FIG. 2 is a plan view, on an enlarged scale, of part of the mould of FIG. 1.

In FIGS. 1 and 2, the mould 10 is a standard one-piece mould of the kind in which a core is inserted to define the inner wall of the moulding space, and the moulded pipe is demoulded by relative axial movement of the mould and the core, followed by withdrawal of the mould from the pipe. On the exterior surface of the wall 12 of the mould are mounted three vertical frames 14, spaced equidistantly around the circumference of the mould. Each frame consists of a vertical beam 16 carried on two horizontal arms 18 that are pivoted on two spaced lugs 20 on the wall 12. The beam can be locked in inward portion by a clevised lever 22 pivoted on a lug 24 on the wall 12, and having a roller 26 spanning the limbs of the lever to provide a space through which projects a nose 28 fast with the beam. The nose is so curved towards its free end that, as the lever is rotated about its pivotal axis towards the beam, it forces the nose, and therefore the beam, towards the wall 12 and locks it.

The beam carries a series of stops 30, which register with holes 32 in the wall 12, and which as the beam is caused to approach the wall, are projected through the thickness of the wall into the moulding space 34. The beam is moved to retract the stops from the moulding space by levering it manually away from the mould.

Figure 3:
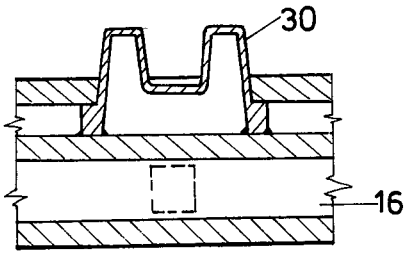
FIG. 3 is a partial section on the line 3—3 of FIG. 2, on an enlarged scale.

As will be seen in FIG. 3, each stop 30 is bifurcated and is tapered, to facilitate demoulding, as will be explained later on.

Figure 5:
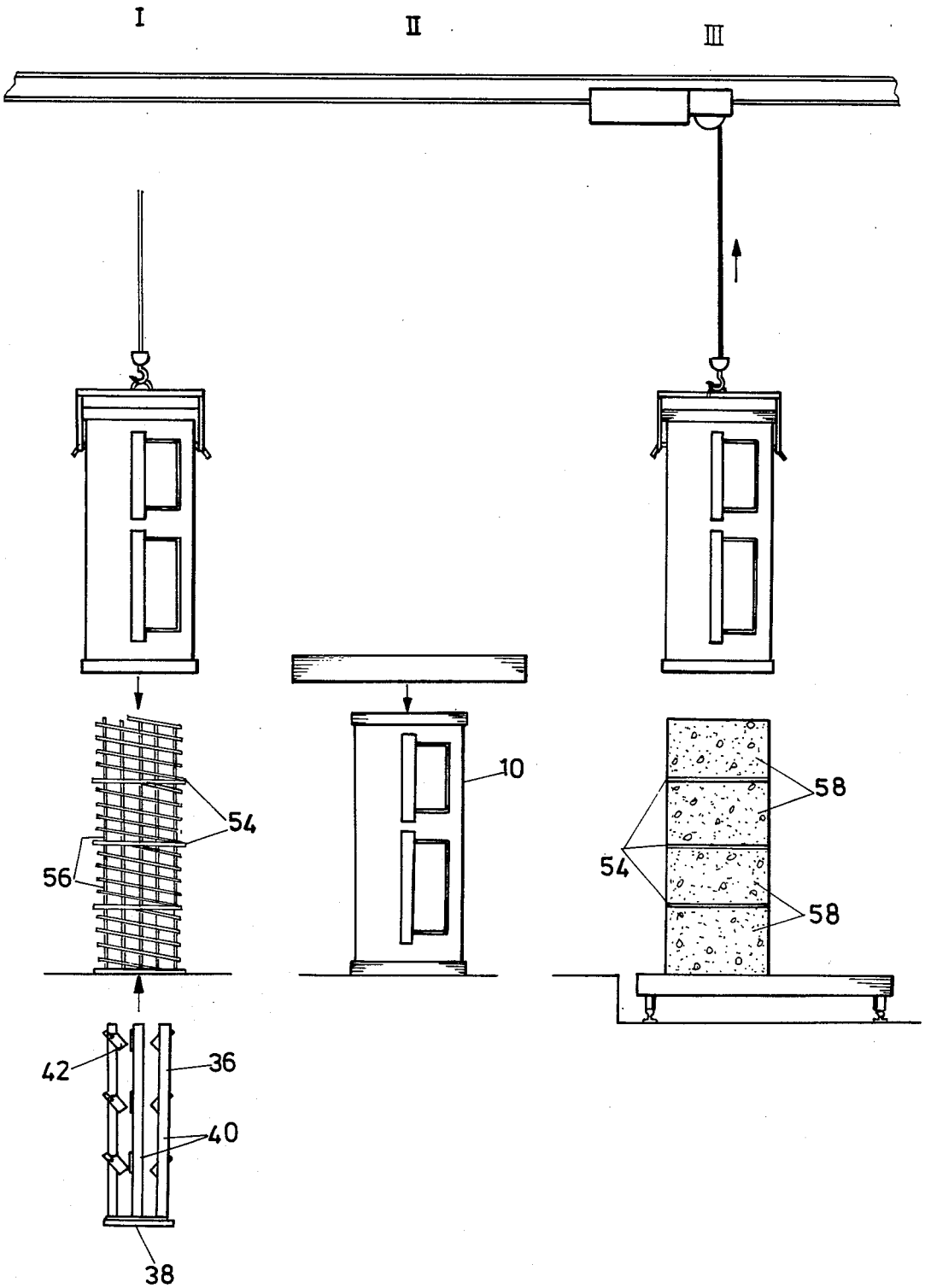
FIG. 5 is a schematic view of a pipe-making operation.

So much for the mould itself. Let us now turn to FIG. 5, which shows the steps in the process of making a pipe.

The process commences at the station designated 1. Here a jig 36 is shown which consists of a base 38 on which are mounted three posts 40. Each post carries a series of brackets 42 pivotally mounted on it, and is shown in more detail in FIG. 6. Each bracket has a nose 44 that provides a ledge 46; and a tail 48 that is counter-weighted at 50. Normally, the bracket is in the pro jected position shown in full lines in FIG. 6, in whicl further rotational movement about the pivot in th counterclockwise position is prevented by any suitabl means such as a stop 51 on the post 40. If, however, th bracket is tilted in the clockwise direction, it pass through a dead centre where the counterweight takes over and the bracket rotates until further rotati is prevented by a stop 52, as is shown by the dott lines.

Figure 6:
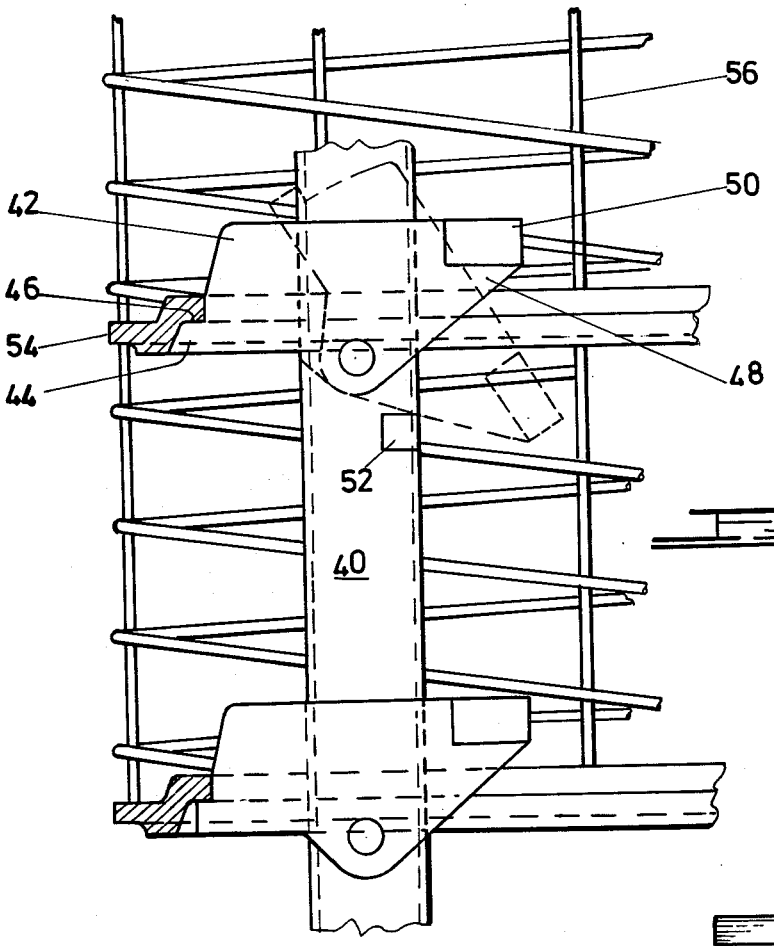
FIG. 6 is a partial vertical section through the jig shown in FIG. 5, on an enlarged scale.

This jig is placed in station I, and is used to form stack around it which consists of a series of rings intercalated with reinforcing cages 56. The lowerm cage rests on the base 38, a ring is threaded over the and is laid upon the projected ledges 46 of the lov most brackets of the jig, as is seen in FIG. 6; a cag is laid upon the ring, a second ring is positioned or second set of ledges; a second cage is laid on the se ring; and so on until the stack has been completed The inside of the mould 10 is only sufficiently l than the outer diameter of the rings 54 for the sta be able to slide relatively into the mould when, as i in FIG. 5, the mould is lowered over it.

It is now necessary to move the mould and the within it into station II. In order to achieve thi things must be done: firstly, the stack must be pos engaged with the mould so that, when the mould is moved, the stack moves with it; and, secondly, the jig must be withdrawn from the stack to free the cavity of the mould for introduction of the compacting rollers, or the vibrating mechanism, whichever system is used.

The engagement of the stack and the mould is effected by projecting the stops 30 through the wall of the mould until they engage the rings 54. When so engaged, the stops, which, it will be recalled, are bifurcated, straddle the thickness of the rings and constrain them against vertical movement relatively to the mould.

The liberation of the jig from the stack is achieved merely by raising the mould, with the stack secured to it by the stops 30, whereupon each set of brackets 42 is shouldered out of the way by the ring below it, and is tilted for the individual brackets to move over their dead centres and come to rest against the stops 52.

When it is completely free from the stack, the jig is immediately ready for the next stack to be formed around it.

In station II, the pipe is cast in the normal way, and the mould, still containing the cast pipe, is moved into station III, where it is to be demoulded. The stops 30 are retracted from the moulding space which now contains the cast pipe, and operation which is facilitated by the tapers on the stops; and the mould in lifted off of the pipe, which consists of a number of relatively short pipes 58, spaced apart by the rings 54, that extend from the inside to the outside of the pipes. The pipe is cured, and the lengths 58 are separated from the rings, which ıre returned to station I for assembly with reinforcing :ages on a jig, as described above.

The rings are, of course, so contoured that they im- art to the pipes 58 the desired end configurations.

Figure 7:
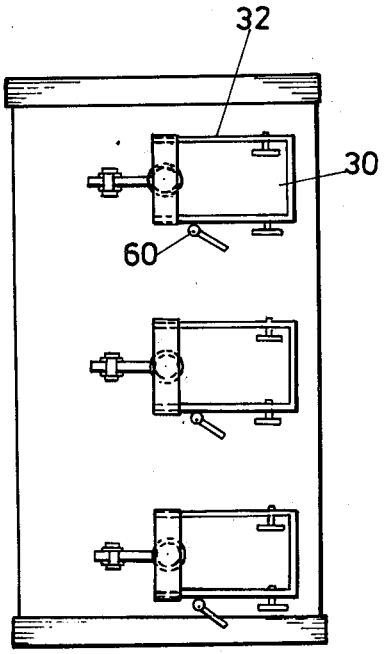
FIG. 7 is a side view of a second embodiment of a mould according to the invention.

It is evident that the rhythm of operations is such that high rate of throughput can be maintained. While the ethod of the invention calls for the formation of the ıcks, a step that is not part of the conventional method here long pipes are moulded in vertical machines, the cking is done while the mould is passing through tions II and III, and, in practice, it is found that there no significant difference in the rate of production ıtively to the normal process. The advantages of the tical machine in the making of normally long pipes therefore preserved in the making of short pipes. ome variations in the method described above are trated in the drawings.

the making of a pipe in a vertical machine in which :ompaction of the cementitious mixture is effected ibration, it is necessary to compress the cast pipe ly, an operation that is not called for when the pipe ler-compacted. To enable this axial compression to ›lace, each ring 54 must be free to move slightly as ›mpressive force is applied. Ganging of the stops in the embodiment of FIGS. 1 and 2, cannot be used, and it is better to provide that each stop and ociated elements be individually mounted, as is ı FIG. 7. Here, the holes 32 in the mould are gular, as are the stops 30. Each stop is somewhat in vertical dimension than its hole, to provide :tween them, and the arm on which the stop is d is loose to allow such play. Initially, the stops l in their uppermost position by means of cams :ed on the mould. When the pipe has been cast endwise pressure is to be applied to it, the cams ısed to enable the stops, and the rings which they support, to move sufficiently to allow the required compaction of the pipe to take place.

Figure 8:
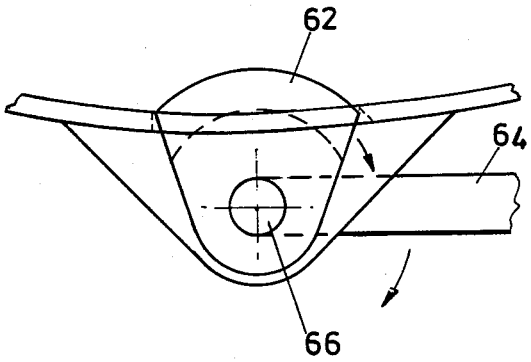
FIG. 8 is a detail of a modified form of stop.

A modification of the stops and their associated structure is shown in FIG. 8. The stop here is a quadrant 62 mounted rigidly on a lever 64 pivoted in lugs 66. The projection and retraction of the stops are effected merely by rotating the levers, or, if the stops are ganged, then by rotating the single lever that operates the gang.

Figure 4:
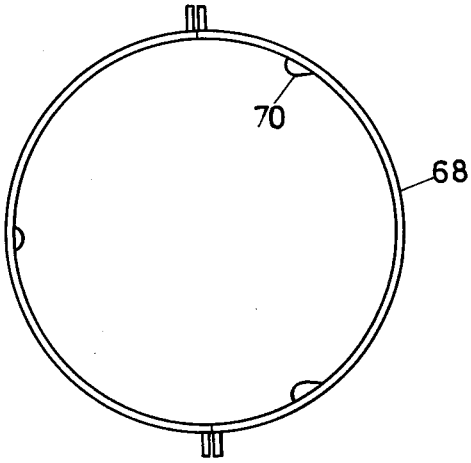
FIG. 4 is a plan view of a separable mould.

Finally, in FIG. 4, a split mould 68 is shown. For this type of mould it is obviously unnecessary to go to the complication of projecting stops into and retracting them from the moulding cavity. Instead, permanent ledges 70 are provided on the inner surface of the mould, which engage the rings 54 when the mould has been put around a stack of rings and cages, when the mould is closed. Opening of the mould automatically withdraws the stops from the cast pipe.

This kind of mould with fixed stops cannot, of course be used in vibration type vertical pipe machines.

We claim:

1. A method of moulding short lengths of pipe in a vertical pipe-making machine, which consists in locating in a cylindrical mould a series of rings, co-axial with the mould, that divide the length of the mould into several compartments; projecting sets of stops through the wall of the mould and into the moulding space before moulding the pipe, one set in respect of each ring; engaging the stops with the rings to locate the rings in the mould, filling the compartments of the mould with settable material; causing or allowing the material to set to form a pipe with the rings embedded in it and extending from the inner to the outer surface of the pipe, retracting the stops and dividing the pipe into lengths by removing the rings from it.

2. The method of claim 1 including the step of stacking the rings co-axially, together with cylindrical reinforcement cages spacing them apart; and locating the mould around the stack before projecting the stops into the moulding space.

3. The method of claim 2, including the step of forming the stack of rings and cages around a jig, with the rings located, aligned, and supported by the jig; then locating the mould around the stack and projecting the stops into engagement with the rings; and withdrawing the jig before moulding the pipe.

4. A method of moulding short lengths of pipe in a vertical pipe-making machine, which consists in locating a jig, then forming around the jig and about a vertical axis a cylindrical stack of several reinforcing cages separated from one another by dividing rings, the rings being aligned and supported by the jig; then locating a cylindrical mould around the stack, with the internal surface of the mould in contact with the rings; projecting into the moulding space, through the wall of the mould, sets of stops, one set for each ring, so that the stops engage and support the rings; moving the mould and the stack relatively to the jig, to withdraw the jig from the stack; introducing settable material into the mould to form a pipe, with the rings extending through the thickness of the pipe wall; causing or allowing the material to set; retracting the stops from the moulding space; demoulding the pipe; and removing the rings to separate the pipe into lengths.

* * * * *